US006843269B2

(12) United States Patent
Verma et al.

(10) Patent No.: US 6,843,269 B2
(45) Date of Patent: Jan. 18, 2005

(54) FUEL TANK SAFETY SYSTEM

(76) Inventors: Sandeep Verma, 95 Crownview Dr., Monroe, CT (US) 06468; Martin A. Shimko, P.O. Box 984, Quechee, VT (US) 05059; Deborah Kamlani Moss, 23 Grove Point Rd., Westport, CT (US) 06880

( * ) Notice: Subject to any disclaimer, the term of this patent is extended or adjusted under 35 U.S.C. 154(b) by 0 days.

(21) Appl. No.: 10/454,826

(22) Filed: Jun. 4, 2003

(65) Prior Publication Data

US 2004/0094201 A1 May 20, 2004

Related U.S. Application Data

(60) Provisional application No. 60/386,138, filed on Jun. 5, 2002.

(51) Int. Cl.[7] ..... G05D 7/00
(52) U.S. Cl. ..... 137/209; 220/88.3
(58) Field of Search ..... 137/209; 220/88.3

(56) References Cited

U.S. PATENT DOCUMENTS 4,378,920 A 4/1983 Runnels et al.
4,556,180 A 12/1985 Manatt
5,904,190 A 5/1999 Patel
5,918,679 A 7/1999 Cramer
6,012,533 A 1/2000 Cramer
6,136,267 A 10/2000 Bergman
2002/0158167 A1 * 10/2002 Schmutz et al. ..... 244/129.2

* cited by examiner

*Primary Examiner*—Gerald A. Michalsky
(74) *Attorney, Agent, or Firm*—Cantor Colburn LLP; Victor E. Libert

(57) ABSTRACT

An apparatus and method for inerting the gas present in the ullage region of a storage tank for combustible liquids, e.g., a fuel tank containing a hydrocarbon liquid fuel, utilizes a molecular sieve zone (2, beds 12/14) which either (a) selectively adsorbs oxygen from the ullage gas to provide an oxygen-depleted return ullage gas, or (b) selectively adsorbs nitrogen from the ullage gas, which nitrogen is desorbed and conveyed by a purge gas to provide a nitrogen-enriched gas. The return ullage gas or the nitrogen-enriched gas is flowed to the ullage region (30, 130) in quantity sufficient to render the overall composition of gas in the ullage region (30, 130) non-combustible and non-explosive. The apparatus may include a compressor (22) or a vacuum pump to flow the ullage gas through the system, and a valving arrangement (16, 18) is used to control the flow of gases. Operation may be intermittent or continuous and may comprise pressure-swing adsorption/desorption to place one of molecular sieve beds (12, 14) on-line to adsorb oxygen or nitrogen from the ullage gas, while the other of molecular sieve beds (12, 14) is off-line being regenerated.

33 Claims, 6 Drawing Sheets

FUEL TANK SAFETY SYSTEM

CROSS REFERENCE TO RELATED APPLICATION

This application claims priority of provisional patent application Ser. No. 60/386,138, filed on Jun. 5, 2002 in the names of Sandeep Verma, Martin A. Shimko and Jeram Kamlani, and entitled "Fuel Tank Safety System."

BACKGROUND OF THE INVENTION

1. Field of the Invention

The present invention concerns an apparatus and method for inerting a storage tank, e.g., a fuel tank, containing a combustible liquid, e.g., a hydrocarbon fuel, and having an ullage region containing oxygen or nitrogen and oxygen, e.g., air. In particular, the present invention concerns an apparatus and method which flows storage tank ullage gas through either (1) an oxygen-scavenging molecular sieve, to produce an oxygen-depleted return ullage gas, or (2) a nitrogen-scavenging molecular sieve which is regenerated by a purge gas to produce a nitrogen-enriched gas. The return ullage gas of case (1) or the nitrogen-enriched gas of case (2) is flowed to the storage tank ullage region to render the gas in the ullage region non-explosive.

2. Related Art

Storage tanks for combustible liquids, such as fuel tanks, have a free space, referred to as the "ullage region", above the liquid level in the tank. Without treatment, the ullage region contains a mixture of combustible vapor (a vaporized portion of the combustible liquid) and air, the composition of which is dependent upon factors such as the temperature and pressure conditions within the tank. At certain oxygen concentrations and combustible liquid temperatures the combustible vapor/air mixture in the ullage region comprises an explosive mixture which may be ignited by a spark. For safety's sake, it is therefore necessary to maintain the ullage region oxygen concentration below that needed to sustain fire or explosion.

Although the following discussion applies to storage tanks for combustible liquids generally, the most commonly encountered situation is fuel tanks containing a hydrocarbon fuel. The safety of fuel tanks aboard aircraft is of particular concern and much of the following discussion is couched in those terms. The concentration of oxygen in the ullage region of a fuel tank is affected by a number of factors including depletion of fuel in the tank, a change in altitude of an aircraft, entry of air into the tank, and rapid pressure reduction in the ullage region. The latter may occur, for example, when an aircraft reaches high altitude in a short time after take-off. The fuel in the fuel tank contains dissolved oxygen (from air) which boils out of the fuel at the reduced pressure present in the ullage region at high altitude, thereby creating an undesired increase in the oxygen concentration in the ullage region. Oxygen is also brought into the fuel tank ullage region as its pressure increases during descent to lower altitude, or landing of an aircraft.

While there are other methods for controlling the amount of oxygen present in the ullage region, the most common method is referred to as fuel tank inerting, which is the introduction of an inert gas, such as nitrogen, into the ullage region of a fuel tank, thereby displacing at least some of the oxygen-containing ullage gas and maintaining the concentration of oxygen within the ullage region at a level low enough that the ullage gas is rendered non-explosive. In many cases, the inert gas used for fuel tank inerting is stored onboard an aircraft or vessel and then introduced into the fuel tank when it is required.

SUMMARY OF THE INVENTION

In accordance with the present invention, there is provided an inerting apparatus connected to a storage tank containing a combustible liquid and having an ullage region containing oxygen, the apparatus comprising the following components. An oxygen-scavenging molecular sieve zone which selectively removes oxygen from a gas flowed through it has an inlet connected by an inlet line in gas-flow communication to the ullage region and an outlet connected by a return line in gas-flow communication with the ullage region. A pressurizing mechanism, e.g., a compressor or vacuum pump, is operably connected to the apparatus, as are one or more valves operable to control flow through the inlet line and the return line to flow ullage gas from the ullage region to and through the molecular sieve zone to provide an oxygen-depleted return ullage gas, and to flow the return ullage gas back to the ullage region.

In accordance with another aspect of the present invention, there is provided an inerting apparatus connected to a storage tank containing a combustible liquid and having an ullage region containing nitrogen and oxygen, the apparatus comprising the following components. A nitrogen-scavenging molecular sieve zone which selectively removes nitrogen from a gas flowed through it has an inlet connected by an inlet line in gas-flow communication to the ullage region, and an outlet. A purge gas line is connected in gas flow communication from a source of purge gas to the molecular sieve zone and thence to the ullage region. A first gas-flow control valve is located in the inlet line and is movable between a closed position and an open position. A second gas-flow control valve is located in the purge gas line and is movable between a closed position and an open position. A pressurizing mechanism, e.g., a compressor or vacuum pump, is operably connected to the apparatus in order (a) to flow ullage gas from the ullage region to and through the molecular sieve zone to load the molecular sieve zone with adsorbed nitrogen when the first gas-flow control valve is in its open position and the second control valve is in its closed position; and (b) to flow purge gas through the molecular sieve zone to desorb nitrogen from the molecular sieve and thereby form a nitrogen-rich gas and flow the nitrogen-rich gas to the ullage zone when the second control valve is positioned to permit such flow and the first control valve is positioned to preclude flow of the ullage gas through the molecular sieve zone.

Another aspect of the present invention provides that the molecular sieve zone comprises two or more molecular sieve beds, each having an associated inlet line connected with a first gas-flow control valve and an associated return line connected with a second gas-flow control valve, the first and second gas-flow control valves being operable to contemporaneously place one of the molecular sieve beds in an adsorption mode and the other of the molecular sieve beds in a regeneration mode.

In certain aspects of the present invention, storage tank is a fuel tank and the combustible liquid is a hydrocarbon fuel, e.g., jet fuel, diesel fuel, gasoline or fuel oil.

A method aspect of the present invention provides a method of inerting a storage tank containing a combustible liquid and having an ullage region containing oxygen, the method comprising the following steps: withdrawing from the ullage region a stream of ullage gas; flowing the ullage gas through an oxygen-scavenging molecular sieve zone to remove oxygen from the ullage gas and thereby provide an oxygen-depleted return ullage gas; and flowing the return ullage gas into the ullage region.

Another aspect of the present invention provides that the oxygen-scavenging zone comprises at least a first molecular sieve bed and a second molecular sieve bed, and wherein the method further comprises (a) passing the ullage gas through the first molecular sieve bed during a first adsorption period, and regenerating the second molecular sieve bed by desorbing oxygen therefrom and flowing a purge gas therethrough during a first regeneration period, (b) passing the ullage gas through the second molecular sieve bed during a second adsorption period, and regenerating the first molecular sieve bed by desorbing oxygen therefrom and passing the purge gas therethrough during a second regeneration period, and (c) withdrawing oxygen-enriched gas resulting from the regeneration of the first and second molecular sieve beds.

The method aspects of the present invention also provide for one or more of the following steps, alone or in combination: periodically reversing the flows of the ullage gas and the purge gas to thereby periodically alternate the first and second molecular sieve beds between adsorption and regeneration periods; carrying out at least a portion of the first adsorption period contemporaneously with at least a portion of the second regeneration period, and carrying out at least a portion of the second adsorption period contemporaneously with at least a portion of the first regeneration period; and pressurizing the ullage gas and cooling the resultant pressurized ullage gas to a temperature suitable for oxygen adsorption in the molecular sieve zone and below the auto-ignition temperature of the pressurized ullage gas, prior to flowing the pressurized ullage gas to the oxygen-scavenging molecular sieve zone. For example, the pressurized ullage gas may be cooled to a temperature within about ±20° C. of the temperature of the combustible liquid, prior to flowing the ullage gas to the oxygen-scavenging molecular sieve zone.

Another method aspect of the present invention provides a method of inerting a storage tank containing a combustible liquid and having an ullage region containing nitrogen and oxygen, the method comprising the following steps: withdrawing from the ullage region a stream of ullage gas; flowing the ullage gas through a nitrogen-scavenging molecular sieve zone to remove nitrogen from the gas by adsorbing it in the molecular sieve zone to thereby form a nitrogen-depleted gas; regenerating the molecular sieve zone by desorbing nitrogen therefrom and flowing a purge gas therethrough to thereby provide a nitrogen-enriched gas; and flowing the nitrogen-enriched gas into the ullage region.

Another method aspect of the present invention provides for the nitrogen-scavenging zone to comprise at least a first molecular sieve bed and a second molecular sieve bed, and wherein the method comprises (a) passing the ullage gas through the first molecular sieve bed during a first adsorption period, to form a nitrogen-depleted gas, and regenerating the second molecular sieve bed by desorbing nitrogen therefrom and flowing a purge gas therethrough during a first regeneration period, (b) passing the ullage gas through the second molecular sieve bed during a second adsorption period to form a nitrogen-depleted gas, and regenerating the first molecular sieve bed by desorbing nitrogen therefrom and flowing the purge gas therethrough during a second regeneration period, and (c) withdrawing nitrogen-depleted gas resulting from the adsorption periods of the first and second molecular sieve beds. Still other aspects of the present invention call for providing the purge gas by flowing a sidestream of the nitrogen-depleted gas through the molecular sieve bed being regenerated, or by providing the purge gas from an external source.

Other method aspects of the present invention provide for carrying out one or more of the following method steps, alone or in combination: periodically reversing the flows of the ullage gas and the purge gas to thereby periodically alternate the first and second molecular sieve beds between adsorption and regeneration periods; carrying out at least a portion of the first adsorption period contemporaneously with at least a portion of the second regeneration period; and carrying out at least a portion of the second adsorption period contemporaneously with at least a portion of the first regeneration period; and pressurizing the ullage gas and cooling the resultant pressurized ullage gas to a temperature suitable for nitrogen adsorption in the molecular sieve zone and below the auto-ignition temperature of the pressurized ullage gas, prior to flowing the pressurized ullage gas to the nitrogen-scavenging molecular sieve zone. For example, the pressurized ullage gas may be cooled to a temperature within about ±20° C. of the temperature of the combustible liquid, prior to flowing the ullage gas to the nitrogen-scavenging molecular sieve zone.

Generally, known pressure-swing adsorption and desorption techniques may be used for adsorption and regeneration cycles of the molecular sieve beds.

As used herein and in the claims, the term "ullage gas" means the fuel vapor and gases, such as air, above the combustible liquid level in a storage tank, i.e., in the ullage region. The ullage gas is oxygen-depleted or a purge gas is nitrogen-enriched by the treatment described herein, and the oxygen-depleted or nitrogen-enriched gas may contain other gases, e.g., added nitrogen or other added inert gases. Use of the term "gas", unless specifically stated otherwise or unless the context unequivocally so requires, is intended to broadly embrace gases containing entrained vapors, such as vapors of combustible liquids.

As used herein and in the claims, reference to a "hydrocarbon fuel" is intended to broadly embrace fuels, such as jet fuel, diesel fuel, gasoline, fuel oil and the like, including conventional additives to such fuels. Reference to a molecular sieve zone or bed "selectively" adsorbing a particular gas means that that gas is adsorbed preferentially relative to the other gases in the gas stream flowed through the molecular sieve.

Other aspects of the present invention are described below and illustrated in the appended drawings.

DETAILED DESCRIPTION OF THE INVENTION AND PREFERRED EMBODIMENTS THEREOF

Generally, there are omitted from the drawings vent valves for the storage tanks, control devices and power sources for operating the pressurizing mechanism, for opening and closing valves, and for switching molecular sieve beds between adsorption pressures and/or temperatures, and desorption pressures and/or temperatures, etc. Such devices and their use are well known in the art.

Figure 1:
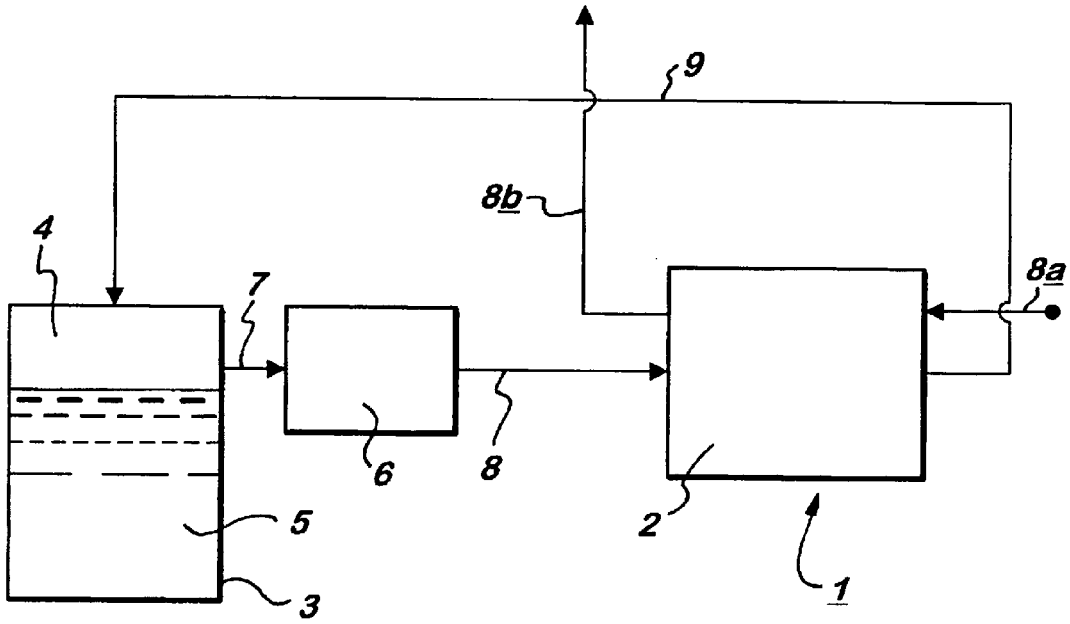
FIG. 1 is a schematic view of an inerting apparatus in accordance with one embodiment of the present invention connected to a fuel tank.

Referring now to FIG. 1, there is schematically shown a fuel tank inerting system 1 in accordance with one embodiment of the present invention, and comprising an oxygen-scavenging molecular sieve zone 2 connected to service a fuel tank 3 which has an ullage region 4 above a liquid hydrocarbon fuel 5. A pressurizing mechanism 6 is provided in the illustrated embodiment by a compressing/cooling zone. In other cases, pressurizing mechanism 6 may be a vacuum pump. Ullage gas is withdrawn from ullage region 4 via line 7 to the compressing/cooling zone of pressurizing mechanism 6 and thence via line 8 to molecular sieve zone 2. Molecular sieve zone 2 comprises a molecular sieve bed which selectively adsorbs oxygen from the ullage gas, resulting in an oxygen-depleted return ullage gas which is transported via return line 9 to ullage region 4. The apparatus of FIG. 1 may be operated continuously or intermittently to reduce the oxygen content in ullage region 4 to below a level which will sustain combustion or explosion. As combustible liquid 5, e.g., a liquid hydrocarbon fuel, is drawn down in tank 3, air will enter ullage region 4 through the usual tank venting valves and the like (not shown). If the apparatus of FIG. 1 is installed in an aircraft, the reduction in pressure within ullage region 4 as the aircraft gains altitude will result in air dissolved in fuel 5 vaporizing into ullage region 4. When the molecular sieve bed of zone 2 is approaching or is at its saturation level for oxygen, it may be desorbed by flowing a purge gas through it via line 8*a* to remove the adsorbed oxygen therefrom in a manner well known in the art. The resulting oxygen-enriched purge gas is removed via vent line 8*b*. As described in more detail below, molecular sieve zone 2 may comprise two or more separate molecular sieve beds so that one or more beds are on-line (receiving usage gas via line 8) and one or more beds are being regenerated (via lines 8*a* and 8*b*).

Figure 2:
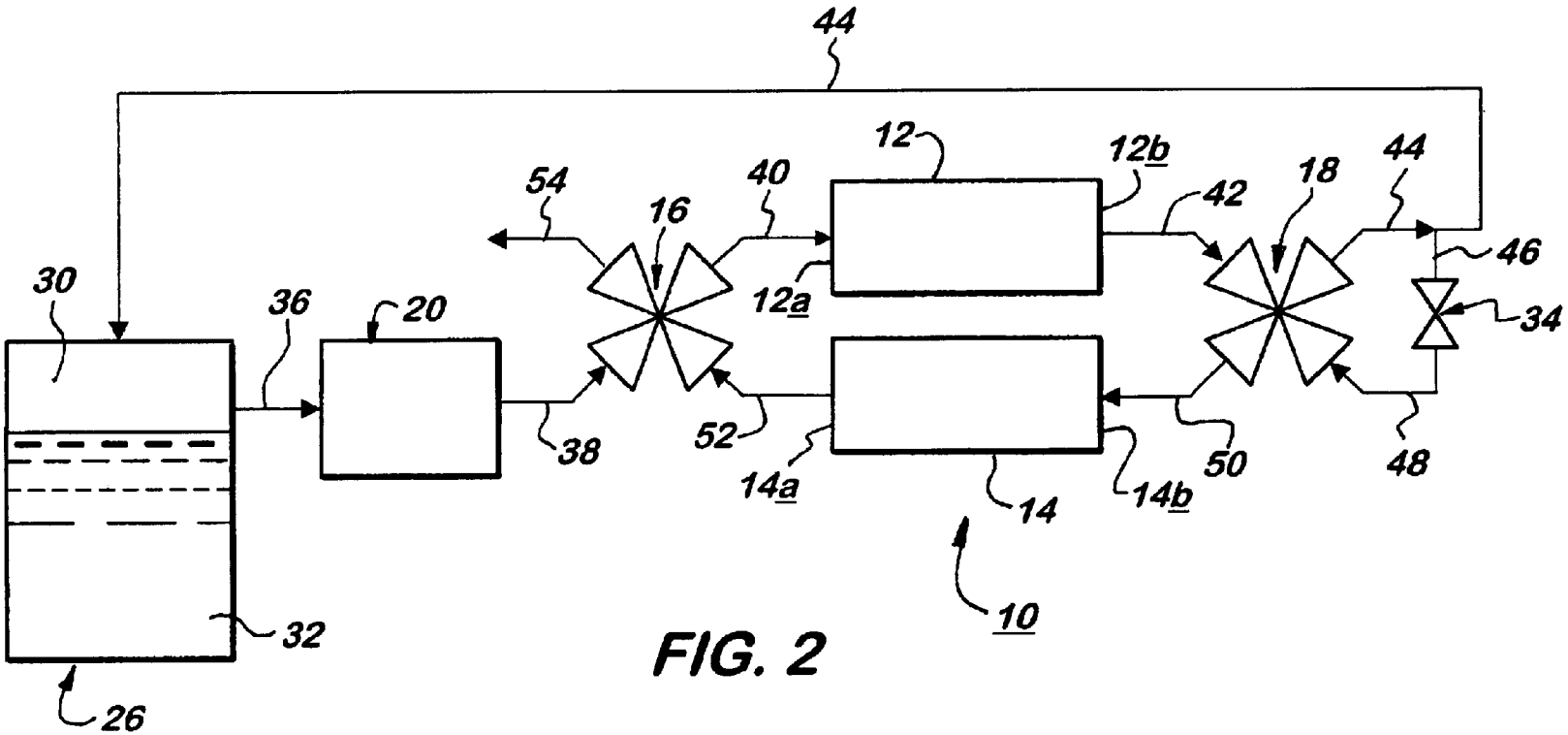
FIG. 2 is a schematic view of an inerting apparatus in accordance with a second embodiment of the present invention connected to a fuel tank, with a first, oxygen-scavenging molecular sieve bed on-line for treating ullage gas from the tank, and a second oxygens-cavenging molecular sieve bed off-line for regeneration.

Referring now to FIG. 2, there is schematically shown a fuel tank inerting system 10 in accordance with another embodiment of the present invention. Inerting system 10 comprises an oxygen-scavenging molecular sieve apparatus connected to service a fuel tank 26, which has an ullage region 30 above a liquid hydrocarbon fuel 32, e.g., jet fuel. The oxygen-scavenging apparatus comprises twin molecular sieve beds 12, 14 having respective first ends 12*a*, 14*a* and respective opposite second ends 12*b*, 14*b*. Molecular sieve beds 12, 14 may contain any suitable oxygen-scavenging molecular sieve material, for example, a molecular sieve material commercially available from Carbotech Anlagenbau GmbH of Essen, Federal Republic of Germany.

Ullage region 30 is connected via a line 36 to a pressurizing mechanism which, in the illustrated embodiment, comprises a compressing/cooling zone 20 from which compressed and cooled ullage gas is withdrawn via line 38 and passed to a first, four-way valve 16, which is interposed between lines 38,40 and lines 52, 54. Lines 40 and 52, respectively, connect first ends 12*a*, 14*a* of molecular sieve beds 12 and 14 to the outlet line 38 of compressing/cooling zone 20 and to a vent line 54. Alternatively, a vacuum pump may be used as the pressurizing mechanism. Lines 42 and 50 respectively connect second ends 12*b*, 14*b* of molecular sieve beds 12, 14 to a second four-way valve 18, which is interposed between lines 42, 50 and lines 44, 48. Lines 42, 50, respectively, connect second ends 12*b*, 14*b* of molecular sieve beds 12 and 14 to ullage region 30 via line 44.

Valves 16 and 18 are four-way valves which are adjustable between a first position and a second position to control the path of gas flow through the molecular sieve beds 12, 14 to place one bed on line and to regenerate the other, as described below.

A sidestream line 46, 48 is connected to line 44 to conduct a small sidestream portion of ullage gas from line 44 via switch valve 34 to valve 18. Switch valve 34 is positioned in sidestream line 46, 48 to control the distribution of the sidestream of compressed and cooled ullage gas to valve 18.

In operation, the ullage gas from ullage region 30 of fuel tank 26 enters compressing/cooling zone 20 by line 36. Compressing/cooling zone 20, as described more fully below with respect to FIG. 4, contains a compressor which pressurizes the ullage gas and a cooler which cools the compressed gas to a temperature equal to or close to that of fuel 32. The compressed, i.e., pressurized, ullage gas is cooled in order to enable it to be efficiently adsorbed by the molecular sieve bed into which it is introduced, and to insure that it is below its auto-ignition temperature. For example, the compressed ullage gas may be cooled to a temperature anywhere in the range of ±20° C. of the temperature of fuel 32. The compressed and cooled gas then exits compressing/cooling zone 20 and enters valve 16 by line 38. Valve 16 is positioned to direct the compressed and cooled ullage gas through line 40 into the first molecular sieve bed 12, which is packed with granulated molecular sieve material that selectively absorbs oxygen while allowing other gases and vapors to pass through. The oxygen-depleted return ullage gas discharged from molecular sieve bed 12 enters valve 18 by line 42. Valve 18 is set to direct the oxygen-depleted return ullage gas via line 44 back to ullage region 30, to provide therein an ullage gas which is sufficiently oxygen-deficient to render the overall gas composition in ullage region 30 non-combustible/non-explosive.

While molecular sieve bed 12 is on-line, molecular sieve bed 14 is regenerated by being purged of the adsorbed oxygen (and other) gases it collected in an earlier cycle while it was on-line. During regeneration the temperature and/or pressure of molecular sieve bed 14 is controlled to promote the desorption of the captured gas molecules, as is well known in the art. A small fraction of the return ullage gas is taken as a sidestream from line 44 by opening switch valve 34 in line 46, 48. This sidestream is directed by line 48 to valve 18, thence into molecular sieve bed 14 by line 50 to sweep away oxygen desorbed from molecular sieve bed 14, and possibly other gases, and carry them from bed 14 via line 52 to valve 16. The sidestream ullage gas containing gases desorbed from molecular sieve bed 14 exits valve 16 and is vented by line 54. The oxygen-enriched vented gas may be further processed or used for any other application using or requiring an oxygen-enriched gas, e.g., as a source of oxygen for breathing. Once molecular sieve bed 14 has been regenerated it can be brought back on-line when molecular sieve bed 12 has reached or is approaching its oxygen adsorption capacity and is taken off-line for regeneration.

Figure 6:
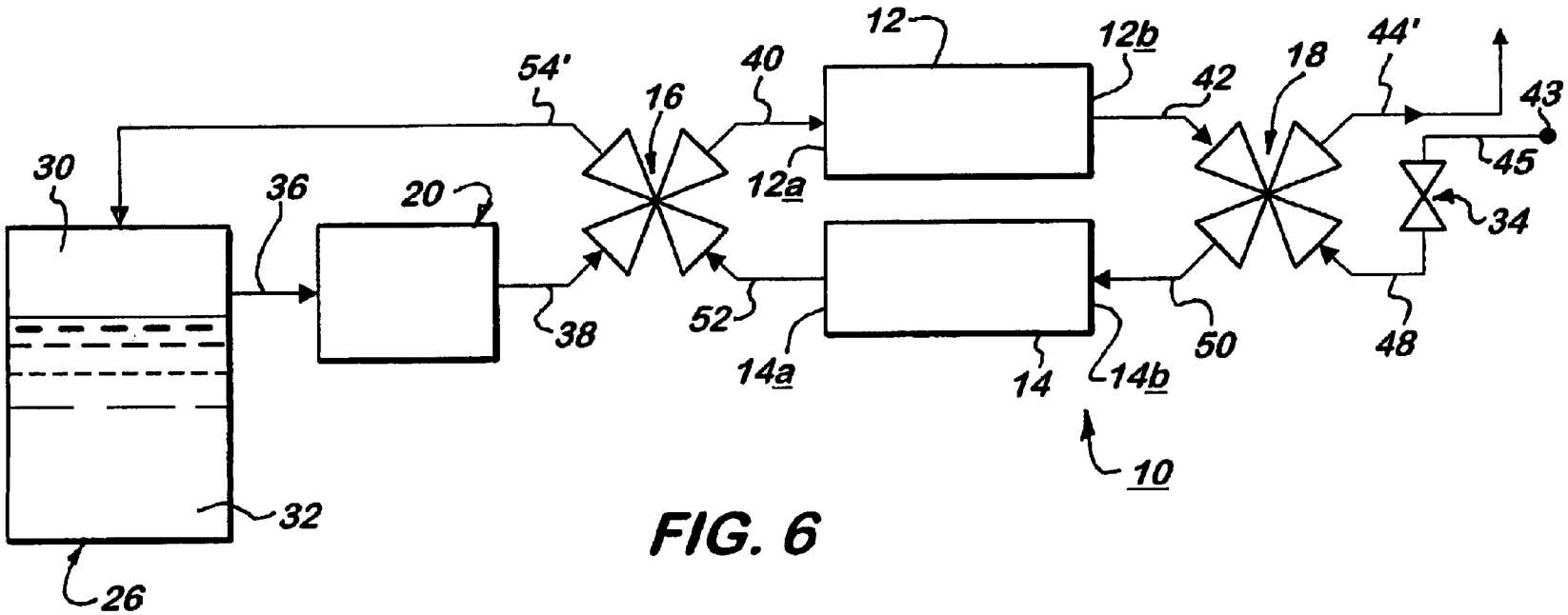
FIG. 6 is a schematic view of an inerting apparatus in accordance with a fifth embodiment of the present invention connected to a fuel tank, with a first nitrogen-scavenging molecular sieve bed on-line for treating ullage gas from the tank, and a second, nitrogen-scavenging molecular sieve bed off-line for regeneration.

Instead of using a sidestream of the return ullage gas as the purge gas, a separate, external source of a suitable purge gas may be employed, as shown, for example, in FIG. 6 in connection with another aspect of the present invention.

Figure 3:
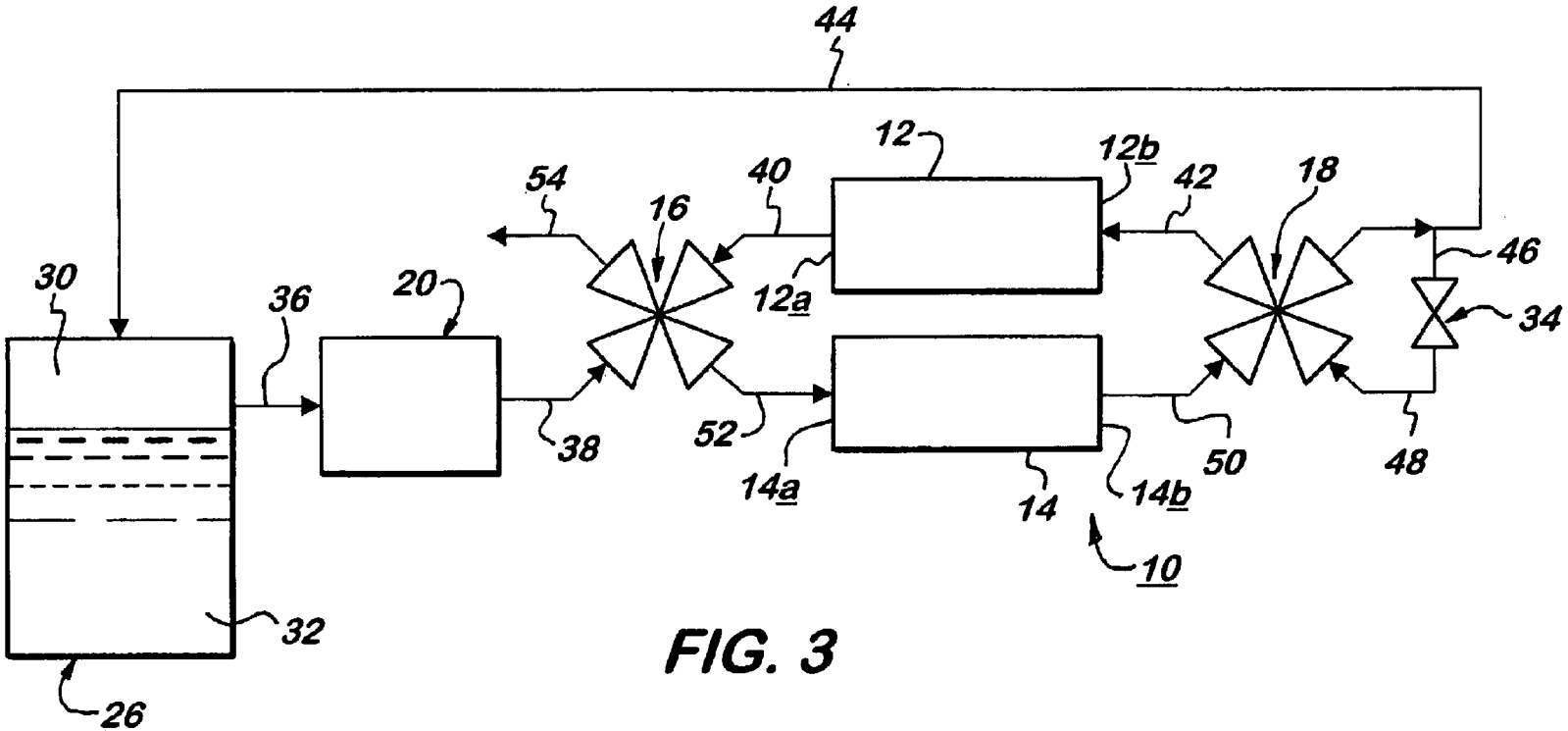
FIG. 3 is a schematic view of the apparatus and fuel tank of FIG. 2 showing the second bed on-line for treating ullage gas and the first bed off-line for regeneration.

As illustrated in FIG. 2, valves 16, 18 and 34 are set in a first position to direct the flow of gases as indicated by the arrowheads on the several lines to place the first molecular sieve bed 12 on-line to remove oxygen from the ullage gas in line 40 and to regenerate the second molecular sieve bed 14 by flowing a sidestream of the ullage gas treated in first bed 12 counter-currently through second bed 14 via lines 50 and 52. Referring now to FIG. 3, the fuel tank inerting system 10 of FIG. 2 is shown with valve settings different from those shown in FIG. 2. As the components of FIG. 2 have been fully described above, that description need not be repeated with respect to FIG. 3. In FIG. 3, valves 16, 18 and 34 are set in a second position to direct the flow of gases as indicated by the arrowheads in FIG. 3 to place molecular sieve bed 14 on-line while molecular sieve bed 12 is being regenerated. Other than reversal of the on-line and off-line status of beds 12 and 14, the process illustrated in FIG. 3 is identical to that described above and illustrated in FIG. 2. Accordingly, the process need not be further described except to note that the positioning of valves 16 and 18 in a second position allows the ullage gas to enter molecular sieve bed 14 by line 52 and to exit by line 50 while the sidestream of return ullage gas, taken from the flow of return ullage gas that has exited valve 18 by line 44, exits valve 18 and enters molecular sieve bed 12 by line 42 and exits molecular sieve bed 12 and enters valve 16 by line 40.

Generally, a single pass of the ullage gas through the molecular sieve oxygen-scavenging system of FIGS. 1 and 2 will significantly reduce the oxygen content of the treated ullage gas, for example, to about one-half of the initial value, regardless of the oxygen content of the incoming ullage gas. Thus, an initial oxygen content of about 20% may be reduced to about 8 to 12% oxygen, e.g., 10% oxygen; an initial oxygen content of about 10% may be reduced to about 4 to 6% oxygen, e.g., 5%, etc. References herein to the percentage of a component of the ullage or other gas is to volume percent.

Figure 4:
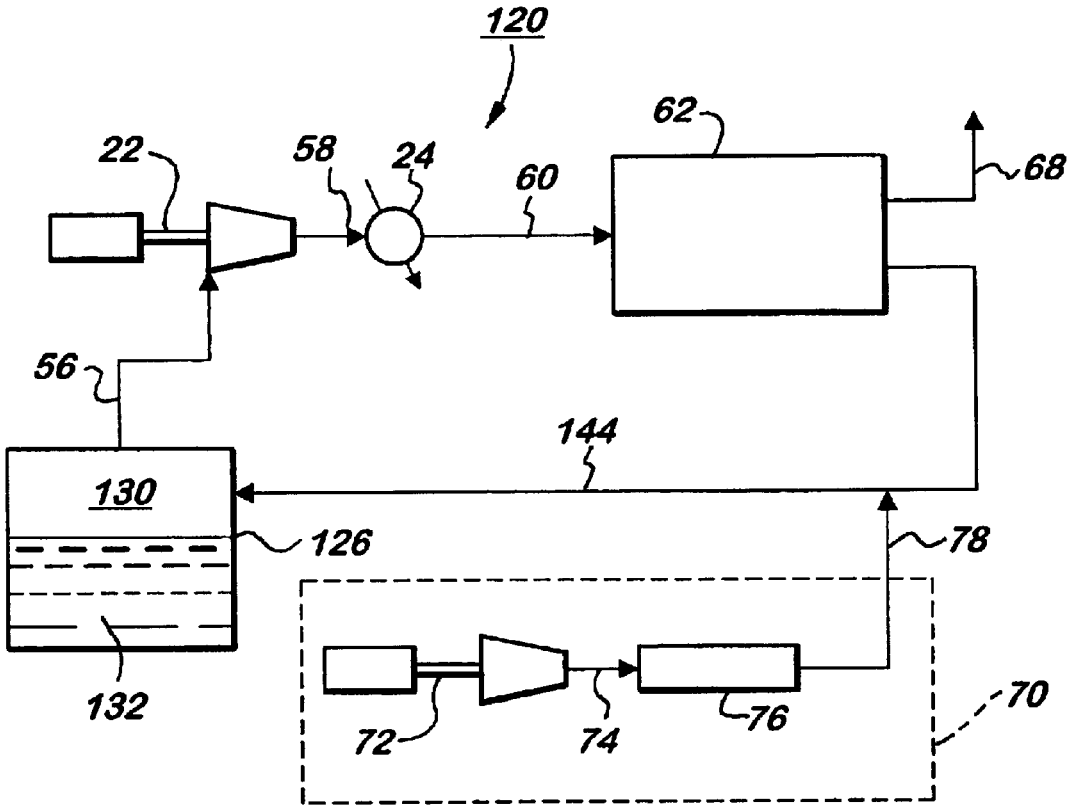
FIG. 4 is a schematic view of a fuel tank inerting system in accordance with a third embodiment of the present invention including an optional make-up gas system.

Referring now to FIG. 4, there is shown a fuel tank inerting system 120 connected to service a fuel tank 126 having an ullage region 130 and containing a liquid fuel 132, e.g., jet fuel. A compressor 22 is connected to ullage region 130 by line 56, and an aftercooler 24 is connected to compressor 22 by line 58. Compressor 22 may be a screw or turbine compressor, e.g., a two-stage screw or turbine compressor. Gas discharged from aftercooler 24 is connected by line 60 to oxygen-scavenging zone 62. Oxygen-scavenging zone 62 is connected to ullage region 130 by return line 144. Oxygen-scavenging zone 62 may comprise the oxygen-scavenging apparatus of FIGS. 1 and 2. Compressor 22 and aftercooler 24 may provide the compressing/cooling zone 20 of FIGS. 2 and 3.

An optional make-up gas purification system 70 may be utilized to supply an inert make-up gas to the fuel tank 126. The make-up system comprises a compressor 72 connected by line 74 to an inert gas generator 76. The outlet of inert gas generator 76, which may be a nitrogen gas generator of the type well known in the art, is connected to line 144 by line 78. Compressor 72 pressurizes generator 76 which releases an inert gas, e.g., nitrogen, which is combined via line 78 with the oxygen-depleted gas in line 144 and is introduced into ullage region 130 of fuel tank 126. Ullage region 130 thus contains a combination of oxygen-depleted ullage gas and inert gas, e.g., nitrogen, with a total oxygen content below that necessary to render the ullage gas in ullage region 130 non-combustible and non-explosive.

Generally, in use, ullage gas is removed from ullage region 130 of fuel tank 126 by line 56 and pressurized in compressor 22. The pressurized ullage gas then enters aftercooler 24 via line 58 and is therein cooled to a temperature close to the temperature in fuel tank 126. The ullage gas then enters the oxygen-scavenging zone 62 via line 60, wherein oxygen is adsorbed, e.g., by the molecular sieve material contained in whichever of the molecular sieve beds 12, 14 of FIGS. 2 and 3 is on-line. Waste gas is removed from oxygen-scavenging zone 62 via line 68. Once the on-line molecular sieve bed 12 or 14 (FIGS. 2 and 3) has reached or is approaching its adsorption capacity, it is taken off-line and the purge gas is then passed through the one of molecular sieve beds 12, 14 to be regenerated, as described above.

In addition to being used to reduce the oxygen content of the ullage region of a fuel tank, the oxygen-scavenging system of the present invention may be utilized to produce a supply of oxygen for emergency breathing or other use. This is accomplished by an adjustment of the operating parameters of the oxygen-scavenging system, i.e., the inlet flow rates, switching times, and regeneration flow rates, to result in a vent-gas flow which can be tailored to produce oxygen at, e.g., greater than 93% purity. (The vent gas is the oxygen-enriched purge gas vented from the system, e.g., via line 54 in FIGS. 2 and 3.) For example, a stream of cooled, engine-compressed air is flowed through the oxygen-scavenging system. As the stream of air passes through the on-line molecular sieve bed, oxygen is removed from the stream of air and retained in the molecular sieve bed. The oxygen-depleted stream of air is then vented from the system. Once the molecular sieve bed has adsorbed sufficient oxygen, e.g., it has reached or is approaching its absorption capacity, it is taken off-line. The temperature and/or pressure within the off-line molecular sieve bed are adjusted to promote the desorption of the captured oxygen. A small flow of engine-bleed air (or other suitable purge gas) is flowed through the off-line molecular sieve bed and carries off the desorbed oxygen, resulting in an oxygen stream which is greater than 93% pure. This high-purity oxygen stream is then flowed to a container where it is either cooled and stored as a liquid or compressed and stored in a gaseous state, to be used as an emergency oxygen supply.

The oxygen-scavenging system of the present invention may also be utilized to produce a supply of a gas (oxygen-depleted air) containing less than 10% oxygen for fire suppression use, e.g., cargo bay fire suppression. This is accomplished by an adjustment of the operating parameters of the oxygen-scavenging system, i.e., the inlet flow rates, switching times, and regeneration flow rates, to result in a stream of air containing less than ten percent oxygen. A stream of cooled, engine compressed air, removed from an engine, is flowed through the oxygen-scavenging system. As the stream of air passes through the on-line molecular sieve bed, oxygen is removed from the stream of air and retained in the molecular sieve bed. The oxygen-depleted air is then flowed, e.g., to the cargo bay, to storage for fire-suppression use, or to suppress an existing fire in an on-demand system. Once the on-line molecular sieve bed has reached its absorption capacity it is taken off-line. The temperature and/or pressure within the off-line molecular sieve bed are adjusted to promote the desorption of the captured oxygen. A small flow of oxygen-depleted air, taken from the oxygen-depleted air discharged from the on-line molecular sieve bed, passes through the off-line molecular sieve bed and carries off the desorbed gas molecules. The waste is then vented from the system.

Figure 5:
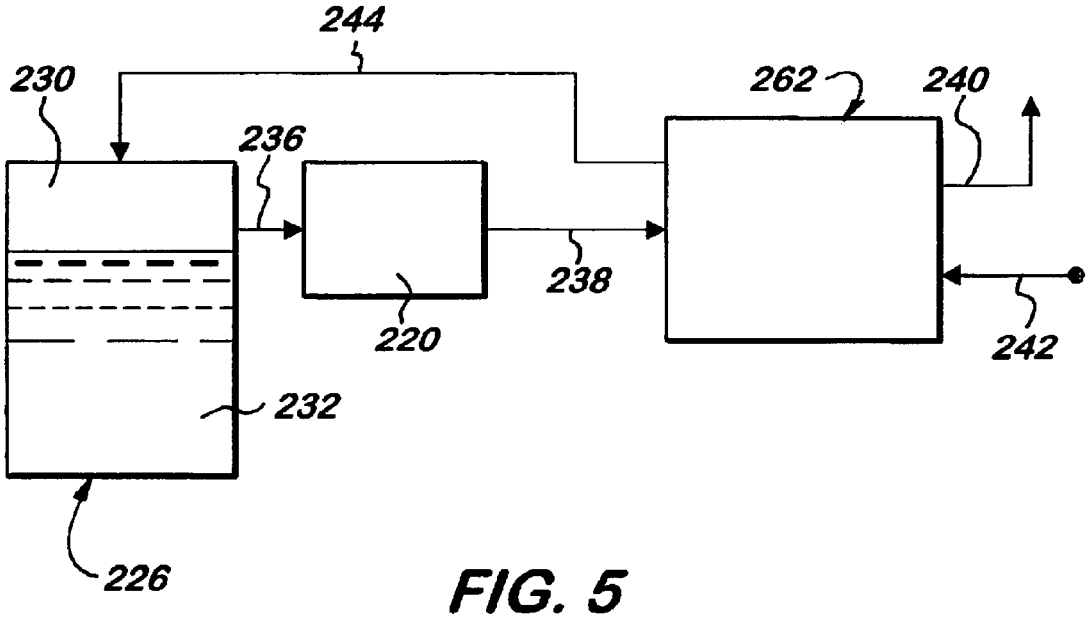
FIG. 5 is a schematic view of an inerting apparatus in accordance with a fourth embodiment of the present invention connected to a fuel tank.

Referring now to FIG. 5, there is schematically shown an embodiment of the present invention in which nitrogen-scavenging molecular sieve beds are employed. Fuel tank 226 has an ullage region 230 above a liquid hydrocarbon fuel 232, for example, jet fuel. A line 236 connects ullage region 230 to a compressing/cooling zone 220, which may comprise compressor 22 and aftercooler 24 as illustrated in FIG. 4. The compressed and cooled gas obtained from compressor/cooling zone 220 is flowed via line 238 to a nitrogen-scavenging zone 262.

The nitrogen-scavenging zone 262 may comprise two molecular sieve beds and associated valving and piping generally as illustrated in FIGS. 2 and 3, except that in this case, the molecular sieve beds contain nitrogen-scavenging molecular sieves instead of oxygen-scavenging molecular sieves. Any suitable nitrogen-scavenging molecular sieve material may be utilized, for example, a molecular sieve material designated PSA02HP (X-Type Sieve Material) and commercially available from UOP Corporation of Mount Laurel, New Jersey. Consequently, in this case, the ullage gas stream passing through the on-line molecular sieve will have nitrogen, and possibly other gases, adsorbed therefrom, and the discharge from the on-line molecular sieve bed will comprise an oxygen-enriched gas which is withdrawn from nitrogen-scavenging zone 262 via line 240, and is either vented from the aircraft or vessel, or sent to storage and/or use as described elsewhere herein. A purge gas is introduced via line 242 into nitrogen-scavenging zone 262 to regenerate the off-line molecular sieve bed within zone 262 by desorbing nitrogen therefrom. The purge gas may, but need not, comprise a sidestream taken from the oxygen-enriched stream emerging from the on-line molecular sieve bed. The resulting nitrogen-rich gas obtained by regenerating the off-line molecular sieve bed with the purge gas is flowed via line 244 to ullage region 230. The desorption gas supplied via line 242 may be a small sidestream taken from any suitable source of gas such as an air-bleed stream from an aircraft jet engine, e.g., from a stage of the engine at which fuel combustion has taken place so that the air-bleed stream has a reduced oxygen content.

Except as specifically described below, the apparatus of FIG. 6 is identical to that of FIGS. 2 and 3, and therefore the components thereof, with the exceptions noted below, are identically numbered to those of FIGS. 2 and 3. The function of the components is, except as otherwise noted below, identical to that of the components of the embodiment of FIGS. 2 and 3, and therefore are not again described. FIG. 6 is a schematic view corresponding to that of FIG. 2, with the following modifications. The twin molecular sieve beds 12 and 14 are nitrogen-scavenging sieve beds instead of the oxygen-scavenging molecular sieve beds of the embodiment of FIGS. 2 and 3. Instead of being supplied with a slipstream from return line 44, as is the case in FIGS. 2 and 3, a separate or external source of purge gas 43 is connected via line 45 to introduce a suitable purge gas into valve 34. Return line 44 of FIGS. 2 and 3 is replaced by vent line 44' of FIG. 6, and line 54' serves as a return line to ullage region 30 of tank 26.

In use, when molecular sieve bed 12 of FIG. 6 is on-line with ullage gas being introduced to it via line 40 and withdrawn from it via line 42, purge gas is introduced via line 45 into valve 34, thence through second control valve 18 and via line 50 into second molecular sieve bed 14, wherein nitrogen adsorbed in that bed during an earlier adsorption cycle of it is withdrawn via line 52, first control valve 16, thence via line 54' to ullage region 30. When molecular sieve bed 12 approaches or is at its nitrogen saturation point, the direction of gas flows is reversed in the manner as described with respect to the embodiment of FIGS. 2 and 3, and nitrogen desorbed from first molecular sieve bed 12 by the purge gas provides the nitrogen-enriched gas which is flowed to ullage region 30. The embodiment of FIG. 6 thus differs from earlier embodiments in that a separate source of purge gas, and not a slipstream of treated ullage gas, is utilized as the purge gas, in this case to desorb nitrogen from the molecular sieve bed being regenerated. A separate source of purge gas instead of a sidestream of treated ullage gas could also be used in the case of oxygen-scavenging molecular sieves. In the case of the embodiment of FIG. 6, an oxygen-rich gas is obtained in line 44', and may either be vented or sent to further processing or use, e.g., to provide a breathable gas for high altitude use in an aircraft or for submerged operations as in a submarine.

While the invention has been described with reference to specific embodiments thereof, it will be appreciated that numerous other variations may be made to the illustrated specific embodiment which variations nonetheless lie within the spirit and the scope of the invention and the appended claims.

What is claimed is:

1. An inerting apparatus connected to a storage tank containing a combustible liquid and having an ullage region containing oxygen, the apparatus comprising:

an oxygen-scavenging molecular sieve zone which selectively removes oxygen from a gas flowed through it and having an inlet connected by an inlet line in gas-flow communication to the ullage region and an outlet connected by a return line in gas-flow communication with the ullage region; and a pressurizing mechanism operably connected to the apparatus together with one or more valves operable to control flow through the inlet line and the return line to flow ullage gas from the ullage region to and through the molecular sieve zone to provide an oxygen-depleted return ullage gas, and to flow the return ullage gas back to the ullage region.

2. An inerting apparatus connected to a storage tank containing a combustible liquid and having an ullage region containing nitrogen and oxygen, the apparatus comprising:

a nitrogen-scavenging molecular sieve zone which selectively removes nitrogen from a gas flowed through it and having an inlet connected by an inlet line in gas-flow communication to the ullage region, and an outlet;

a purge gas line connected in gas flow communication from a source of purge gas to the molecular sieve zone and thence to the ullage region;

a first gas-flow control valve in the inlet line is movable between a closed position and an open position;

a second gas-flow control valve in the purge gas line is movable between a closed position and an open position;

a pressurizing mechanism operably connected to the apparatus (a) to flow ullage gas from the ullage region to and through the molecular sieve zone to load the molecular sieve zone with adsorbed nitrogen when the first gas-flow control valve is in its open position and the second control valve is in its closed position; and (b) to flow purge gas through the molecular sieve zone to desorb nitrogen from the molecular sieve and thereby form a nitrogen-rich gas and flow the nitrogen-rich gas to the ullage zone when the second control valve is positioned to permit such flow and the first control valve is positioned to preclude flow of the ullage gas through the molecular sieve zone.

3. The inerting apparatus of claim 1 or claim 2 wherein the pressurizing mechanism comprises a vacuum pump.

4. The inerting apparatus of claim 1 or claim 2 wherein the pressurizing mechanism comprises a compressor.

5. The apparatus of claim 1 wherein the pressurizing mechanism comprises a compressor, and further comprising a heat exchanger disposed between the compressor and the oxygen-scavenging molecular sieve zone to cool compressed gas discharged from the compressor.

6. The apparatus of claim 5 wherein the compressor and the heat exchanger are disposed in the inlet line between the ullage region and the molecular sieve zone.

7. The apparatus of claim 1 further comprising:

a first gas-flow control valve in the inlet line movable between a closed position and an open position;

a purge gas line connected in gas-flow communication between a source of purge gas and the molecular sieve zone;

a discharge line connected in gas-flow communication with the molecular sieve zone; and a second gas-flow control valve in the purge gas line movable between a closed position and an open position;

whereby the pressurizing mechanism will (a) direct flow of the ullage gas into the inlet of the molecular sieve zone to place the molecular sieve zone in the scavenging mode when the first gas-flow control valve is in its open position and the second gas-flow control valve is in its closed position, and (b) direct flow of the purge gas through the molecular sieve zone and thence discharge line to place the molecular sieve zone in the regeneration mode when the first gas-flow control valve is in its closed position and the second gas-flow control valve is in its open position.

8. The apparatus of claim 2 or claim 7 wherein the molecular sieve zone comprises two or more molecular sieve beds, each having an associated inlet line connected with the first gas-flow control valve and an associated return line connected with the second gas-flow control valve, the first and second gas-flow control valves being operable to contemporaneously place one of the molecular sieve beds in an adsorption mode and the other of the molecular sieve beds in a regeneration mode.

9. The apparatus of claim 1, claim 2, claim 6 or claim 7 wherein the storage tank is a fuel tank and the combustible liquid is a hydrocarbon fuel.

10. The apparatus of claim 2 wherein the pressurizing mechanism comprises a compressor, and further comprising a heat exchanger disposed between the compressor and the nitrogen-scavenging molecular sieve zone to cool compressed gas discharged from the compressor.

11. The apparatus of claim 10 wherein the compressor and the heat exchanger are disposed in the inlet line between the ullage region and the molecular sieve zone.

12. An inerting apparatus for a storage tank containing a combustible liquid and having an ullage region containing oxygen, the apparatus comprising:

an oxygen-scavenging molecular sieve zone comprising at least first and second regenerable oxygen-scavenging sub-zones, the first sub-zone having one end to which is connected a first gas-flow line and a second end to which is connected a second gas-flow line, the second sub-zone having a first end to which is connected a third gas-flow line and a second end to which is connected a fourth gas-flow line;

a first control valve member to which the first and third gas-flow lines are connected in gas-flow communication;

an ullage gas inlet connected in gas-flow communication to the first control valve member;

a second control valve member to which the second and fourth gas-flow lines are connected in gas-flow communication;

an ullage gas return line connected in gas-flow communication between the second control valve member and the oxygen-scavenging zone;

a purge gas line connected in gas-flow communication between a purge gas source and the second control valve member; and a pressurizing mechanism connected to the apparatus to flow gas therethrough, the first and second control valve members being operable to flow a stream of ullage gas through at least one of the oxygen-scavenging sub-zones and the resulting oxygen-depleted ullage gas from that sub-zone to the storage tank ullage region as return ullage gas.

13. The apparatus of claim 12 wherein the purge gas source is a sidestream of the oxygen-depleted ullage gas.

14. An inerting apparatus for a storage tank containing a combustible liquid and having an ullage region containing nitrogen and oxygen, the apparatus comprising:

a nitrogen-scavenging molecular sieve zone comprising at least first and second regenerable nitrogen-scavenging molecular sieve sub-zones, the first sub-zone having one end to which is connected a first gas-flow line and a second end to which is connected a second gas-flow line, the second sub-zone having a first end to which is connected a third gas-flow line and a second end to which is connected a fourth gas-flow line;

a first control valve member to which the first and third gas-flow lines are connected in gas-flow communication;

an ullage gas inlet connected in gas-flow communication to the first control valve member;

a second control valve member to which the second and fourth gas-flow lines are connected in gas-flow communication;

an ullage gas return line connected in gas-flow communication between the first control valve member and the molecular sieve;

a purge gas line connected in gas-flow communication between a purge gas source and the second control valve member to flow a purge gas through, and thereby desorb nitrogen from, the molecular sieve zone to provide a nitrogen-enriched gas;

a pressurizing mechanism connected to the apparatus to flow gas therethrough; the first and second control valve members being operable to contemporaneously flow a stream of ullage gas through one of the molecular sieve sub-zones to provide a stream of nitrogen-depleted gas, and to flow the nitrogen-enriched gas from the other molecular sieve sub-zone to the storage tank ullage region.

15. The apparatus of claim 14 wherein the source of purge gas is the stream of nitrogen-depleted gas.

16. The apparatus of claim 14 wherein the source of purge gas is a source other than the ullage gas.

17. The apparatus of claim 12 or claim 14 wherein the pressurizing mechanism comprises a compressor and an aftercooler disposed in the gas-flow circuit downstream (as sensed in the direction of gas flow) of the compressor.

18. The apparatus of claim 12 or claim 14 where the pressurizing mechanism comprises a vacuum pump.

19. A method of inerting a storage tank containing a combustible liquid and having an ullage region containing oxygen, the method comprising the steps of:

withdrawing from the ullage region a stream of ullage gas;

flowing the ullage gas through an oxygen-scavenging molecular sieve zone to remove oxygen from the ullage gas and thereby provide an oxygen-depleted return ullage gas, and flowing the return ullage gas into the ullage region.

20. The method of claim 19 wherein the oxygen-scavenging molecular sieve zone comprises at least a first molecular sieve bed and a second molecular sieve bed, and wherein the method comprises (a) passing the ullage gas through the first molecular sieve bed during a first adsorption period, and regenerating the second molecular sieve bed by desorbing oxygen therefrom and flowing a purge gas therethrough during a first regeneration period, (b) passing the ullage gas through the second molecular sieve bed during a second adsorption period, and regenerating the first molecular sieve bed by desorbing oxygen therefrom and passing the purge gas therethrough during a second regeneration period, and (c) withdrawing oxygen-enriched gas resulting from the regeneration of the first and second molecular sieve beds.

21. The method of claim 20 including providing the purge gas by flowing a sidestream of the return ullage gas through the molecular sieve bed being regenerated.

22. The method of claim 20 or claim 21 further comprising periodically reversing the flows of the ullage gas and the purge gas to thereby periodically alternate the first and second molecular sieve beds between adsorption and regeneration periods.

23. The method of claim 20 or claim 21 wherein at least a portion of the first adsorption period is carried out contemporaneously with at least a portion of the second regeneration period, and at least a portion of the second adsorption period is carried out contemporaneously with at least a portion of the first regeneration period.

24. The method of claim 19 or claim 20 further comprising pressurizing the ullage gas and cooling the resultant pressurized ullage gas to a temperature suitable for oxygen adsorption in the molecular sieve zone and below the auto-ignition temperature of the pressurized ullage gas, prior to flowing the pressurized ullage gas to the oxygen-scavenging molecular sieve zone.

25. The method of claim 19 or claim 20 further comprising pressurizing the ullage gas and cooling the resultant pressurized ullage gas to a temperature within about ±20° C. of the temperature of the combustible liquid, prior to flowing the pressurized ullage gas to the oxygen-scavenging molecular sieve zone.

26. A method of inerting a storage tank containing a combustible liquid and having an ullage region containing nitrogen and oxygen, the method comprising the steps of:

withdrawing from the ullage region a stream of ullage gas;

flowing the ullage gas through a nitrogen-scavenging molecular sieve zone to remove nitrogen from the gas and adsorb it in the molecular sieve zone, to form a nitrogen-depleted gas;

regenerating the molecular sieve zone by desorbing nitrogen therefrom and flowing a purge gas therethrough to thereby provide a nitrogen-enriched gas; and flowing the nitrogen-enriched gas into the ullage region.

27. The method of claim 26 wherein the nitrogen-scavenging molecular sieve zone comprises at least a first molecular sieve bed and a second molecular sieve bed, and wherein the method comprises (a) passing the ullage gas through the first molecular sieve bed during a first adsorption period to form a nitrogen-depleted gas, and regenerating the second molecular sieve bed by desorbing nitrogen therefrom and flowing a purge gas therethrough during a first regeneration period, (b) passing the ullage gas through the second molecular sieve bed during a second adsorption period to form a nitrogen-depleted gas, and regenerating the first molecular sieve bed by desorbing nitrogen therefrom and flowing the purge gas therethrough during a second regeneration period, and (c) withdrawing nitrogen-depleted gas resulting from the adsorption periods of the first and second molecular sieve beds.

28. The method of claim 27 including providing the purge gas by flowing a sidestream of the nitrogen-depleted gas through the molecular sieve bed being regenerated.

29. The method of claim 27 or claim 28 further comprising periodically reversing the flows of the ullage gas and the purge gas to thereby periodically alternate the first and second molecular sieve beds between adsorption and regeneration periods.

30. The method of claim 27 or claim 28 wherein at least a portion of the first adsorption period is carried out contemporaneously with at least a portion of the second regeneration period, and at least a portion of the second adsorption period is carried out contemporaneously with at least a portion of the first regeneration period.

31. The method of claim 27 or claim 28 further comprising pressurizing the ullage gas and cooling the resultant pressurized ullage gas to a temperature suitable for nitrogen adsorption in the molecular sieve zone and below the auto-ignition temperature of the pressurized ullage gas, prior to flowing the pressurized ullage gas to the nitrogen-scavenging molecular sieve zone.

32. The method of claim 27 or claim 28 further comprising pressurizing the ullage gas and cooling the resultant pressurized ullage gas to a temperature within about ±20° C. of the temperature of the combustible liquid, prior to flowing the ullage gas to the nitrogen-scavenging molecular sieve zone.

33. The method of claim 27 including providing the purge gas from an external source.

* * * * *